United States Patent [19]

Nilsson et al.

[11] 4,117,764

[45] Oct. 3, 1978

[54] VIBRATION ATTENUATING DEVICE

[76] Inventors: Göran Alfred Nilsson, Box 61, 820 22 Sandarne; Kjell Edström, Asbacksgatan 45, 826 00 Soderhamn; Henry Wiklund, Backragen 1, 820 10 Arbra, all of Sweden

[21] Appl. No.: 777,727

[22] Filed: Mar. 15, 1977

[30] Foreign Application Priority Data

Mar. 15, 1976 [SE] Sweden ..... 032523

[51] Int. Cl.[2] ..... F01L 21/02; F01B 15/02

[52] U.S. Cl. ..... 91/50; 91/217; 91/325

[58] Field of Search ..... 91/50, 232, 325, 217

[56] References Cited

U.S. PATENT DOCUMENTS

| | | | |
|---|---|---|---|
| 1,780,817 | 11/1930 | Dubois | 91/50 |
| 3,236,157 | 2/1966 | Lovell et al. | 91/50 |
| 3,427,987 | 2/1969 | Gull | 91/50 |
| 3,862,544 | 1/1975 | Callahan | 91/50 |

FOREIGN PATENT DOCUMENTS

| | | |
|---|---|---|
| 1,011,819 | 7/1957 | Fed. Rep. of Germany. |
| 2,612,218 | 10/1976 | Fed. Rep. of Germany. |
| 366,239 | 4/1974 | Sweden. |
| 431,317 | 7/1935 | United Kingdom. |
| 488,549 | 7/1938 | United Kingdom. |

*Primary Examiner*—Paul E. Maslousky
*Attorney, Agent, or Firm*—Eric Y. Munson

[57] ABSTRACT

A vibration attenuating device to be used in conjunction with reciprocating-motion type impact mechanisms having working and stop members that are axially movable relative towards or away from one another. The members define a pressure chamber therebetween, which is in communication with a source of pressure medium and is sealed by a flexible sealing material such as an O ring. Each member is acted upon by a compression spring exerting a force on the individual member in a direction towards the other member. The introduction of the pressure medium into the pressure chamber results in a cycle comprising the (1) members being forced away from each other, (2) the pressure medium escaping from the pressure chamber and (3) the members being returned to their original positions by the action of the springs. The invention provides a completely balanced two mass system which is particularly useful in conjunction with impact mechanisms used for hand tools. This balanced two mass system attenuates tool vibrations that would normally be transmitted to the operator of this tool.

5 Claims, 4 Drawing Figures

VIBRATION ATTENUATING DEVICE

An object of the present invention is to overcome the above-mentioned drawbacks of the prior art by providing a balanced system for attenuating vibrations in implements such as hand tools equipped with fluid pressure operated impact mechanisms wherein the vibrations transmitted to the housing or handle of the tool are substantially eliminated.

SUMMARY OF THE INVENTION

The present invention provides a balanced fluid pressure operated reciprocating motion impact device for attenuating vibrations to be used with implements such as hand tools, whereby the vibrations transmitted to the handle or housing of the tool when the tool is idling or when the tool is brought into contact with the workpiece are substantially eliminated.

This novel feature results from the fact that the impact mechanism vibration attenuating device is comprised of a spring suspended, balanced two mass system.

Briefly described, the present impact device for attenuating vibrations comprises a reciprocating working member and a stop member located within a housing and defining a pressure chamber therebetween, the working and stop members being axially movable relative to each other. The working member is rigidly connected to an implement, for example, a chisel. The pressure chamber is sealed in the radial direction by a flexible sealing member which can be, for example, an O-ring. Means for supplying a fluid pressure medium to the pressure chamber and means for regulating the amount of the pressure medium supplied to the pressure chamber are provided. The stop member is movably journalled on a shaft provided for this purpose, and the stop member is acted on by a compression spring exerting a force on this member in a direction towards the working member. A second compression spring exerts a force upon the working member in a direction towards the stop member.

When the pressure medium is supplied to the pressure chamber, the forces exerted therein by the medium tend to cause the pressure chamber to expand, driving the working member and the stop member away from each other. Both of these members are being moved against the forces being exerted upon them by their respective compression springs. At a certain instant during the expansion of the pressure chamber, the flexible sealing member, which up until this point is being stretched and deformed, will snap back into its original shape, thereby allowing the pressure medium to escape in the radial direction from the pressure chamber. The working member and the stop member then are moved towards each other by the forces exerted by their respective compression springs and are held in their relaxed position, i.e. the position they maintained relative to each other before the pressure medium was introduced into the pressure chamber, by their respective springs until more pressure medium is introduced into the pressure chamber to start another cycle of the above described action.

Since the working member and the stop member form a spring suspended, balanced two-mass system, no significant vibrations are transmitted to the housing or handle of the tool, because the two vibrations produced by the apparatus of the tool are attenuated by the interaction of the working members and stop members and their respective springs.

DESCRIPTION OF PREFERRED EMBODIMENTS

Figure 1:
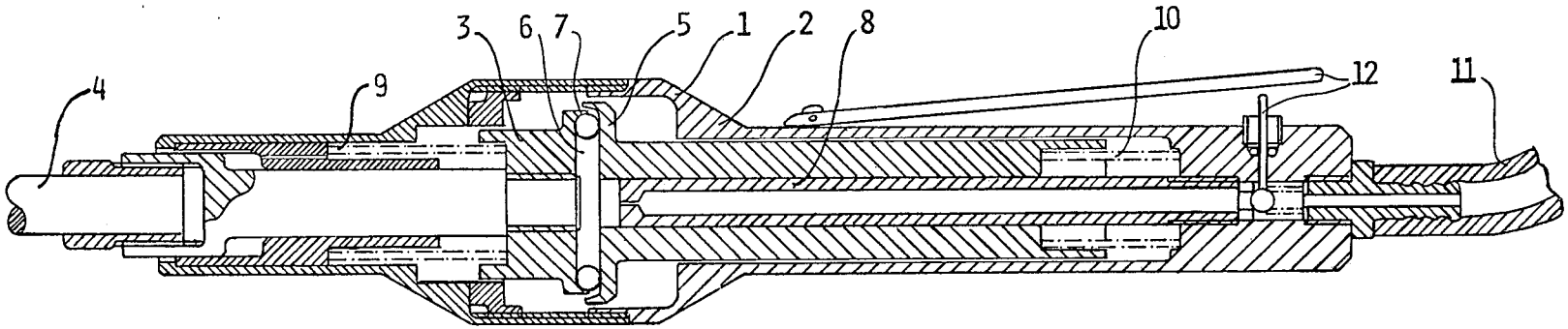
FIG. 1 is a side elevation of a vibration attenuating device constructed in accordance with the present invention.

Referring to the drawings in greater detail, FIG. 1 shows a tool 1 having a housing 2. Located within said housing is a reciprocating motion working member 3 and a stop member 5. A chisel 4 is rigidly connected to the working member 3. Between the working member 3 and the stop member 5, a pressure chamber 6 is provided. Pressure chamber 6 is sealed in the radial direction by a flexible sealing member 7, which, for example, can be an O-ring. The stop member 5 is movably journalled on a shaft 8. Shaft 8 also functions as a supply conduit for the pressure medium which will be described below. Compression springs 9 and 10 urge the working member and the stop member towards one another, the spring 9 exerting a force on the working member in the direction towards the stop member, and spring 10 exerting a force on the stop member in a direction towards the working member. A hose 11 is connected to tool 1 for the purpose of supplying the pressure medium to the tool. A valve device 12 located at a point near where hose 11 communicates with tool 1, provides a means for regulating the supply of pressure medium to the tool. The pressure medium enters the tool 1 from hose 11 and passes through valve 12 and through a passage into the pressure chamber 6.

The above-described vibration attenuating device operates as follows. When the pressure medium is supplied to pressure chamber 6, the working member 3 is forced to move in a direction towards the front of the tool, i.e. the chisel, and away from the stop member 5. This direction of movement of working member 3 is going against the force being exerted by spring 9, which exerts a force on the working member in a direction towards the back of the tool. At the same time this is occurring, the stopping member, because of the pressures being exerted on it by the pressure medium, is being forced to move in a direction towards the back of the tool, i.e. away from the working member and in a direction against the direction in which spring 10 is exerting a force upon stopping member 5.

The net result of the above action is that pressure chamber 6 expands in volume and flexible sealing member 7 is being stretched to maintain its seal because the working member and the stop member are moving in directions away from one another. According to Swedish Patent Application No. 7503970-1 and our co-pending U.S. patent application Ser. No. 673,308, now U.S. Pat. No. 4,033,062, as was mentioned in the discussion of prior art, the flexible sealing member 7 will, during the initial phase of the expansion of the pressure chamber, maintain its sealing function between the working and stop members, since, due to the pressure exerted by the pressure medium, the sealing member is deformed to a larger dimension in the axial direction than its nominal dimension. At the point where maximum deformation of the flexible sealing member occurs, the sealing member will rapidly snap back into its original shape, thereby allowing the pressure medium to escape from the pressure chamber in the radial direction. When all the pressure medium in the pressure chamber escapes, there is no longer any force being exerted upon the working member and the stopping member to drive them apart from one another. The respective compression springs of each member become the dominant forces exerted on the members and drive them in a direction towards one another until the members assume the relaxed position relative to one another, i.e. the position assumed by the respective members before the pressure medium was introduced into the pressure chamber. In this position the O-ring or flexible sealing means again completely seals the pressure chamber. The above cycle may now again be repeated by the reintroduction of more pressure medium into the pressure chamber.

Since the working member 3 and the stop member 5 form a spring suspended, two mass system with the two masses working in phase away from and towards one another, the system is completely balanced so that the housing will not be affected by the work of the impact mechanism except in a very small degree which may be due to bearing friction flow of the pressure mediun or other minor factors.

Figure 3:
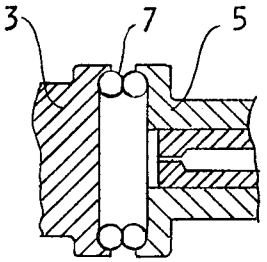
FIGS. 3 and 4 show various possible arrangements of seals located between the working and stop members of the present invention.

When the operator applies the point of chisel 4 to a workpiece, pressing it hard against the workpiece, spring 10 will be compressed to some degree, causing the working member 3, the stop member 5 and the working chamber 6 with its flexible seal 7 between the two members to move a short distance backwards. The spring 10 thereby receives a somewhat harder pre-tension, but the working member 3 and the stop member 5 are still functioning as a two mass balance system so that the vibrations caused by the operation of the impact mechanism are not transmitted to the operator, despite the fact that the tool is pressed against the workpiece. The only effect produced is a "soft" spring movement of the tool, which does not cause any discomfort to the operator. This is an advantage, which from the viewpoint of the operator's protection, is of almost revolutionary importance when compared with the earlier which seals can be positioned at the ends of both the working members 3 and the stop member 5. The result of a double sealing arrangement, as illustrated in FIG. 3, is that working member 3 and stop member 5 will be moved apart from each other a greater distance before the pressure medium escapes than they would be moved if only one seal were used. This results in a longer stroke, i.e. the pressure chamber expanding to a greater volume and the working and stop members moving farther apart from each other before the pressure medium escapes, and a longer time period for one complete cycle to occur as was described with respect to FIG. 1, than when only one seal is used.

Figure 4:
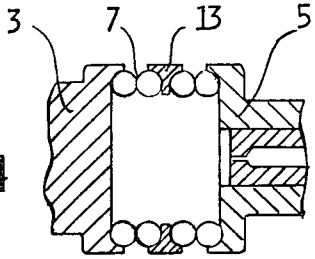

FIG. 4 shows another embodiment of the present invention in which a plurality of flexible seals are arranged between the working member and the stop member. This arrangement is accomplished by positioning a ring 13 between working member 3 and stop member 5. Ring 13 has seats to accommodate a flexible seal 7 on each side of the ring. Ring 13 is axially movable with respect to working member 3, and stop member 5 can automatically adjust its position between the working and stop members in accordance with the stroke lengths of the respective members and the compression of the spring 10 which results when the tool is compressed against the workpeice. Ring 13 can be guided axially by the side walls of the pressure chamber. If the seals 7 are secured to each other, for example, by vulcanization, to form pairs, these seals can then be guided by their seats in the working and stop members and therefore guide the ring 13. In this situation, ring 13 can be provided with play relative to the side walls of the pressure chamber. It is readily apparent that, in order to further increase the stroke lengths of the cycle of this device, a plurality of rings 13 or flexible seal 7 known fluid pressure operated impact mechanisms for chiseling tools and other hand operated tools.

Therefore, this vibration attenuating device used in impact mechanisms provides a completely balanced mechanism in which either none or only a negligible amount of vibrations are transmitted to the housing when the tool is idling and when the tool is brought in contact with the workpiece, because the vibration attenuating device comprises a balanced two mass system in which a plurality of springs attenuates vibrations that would otherwise be transmitted to the operator of the tool.

Figure 2:
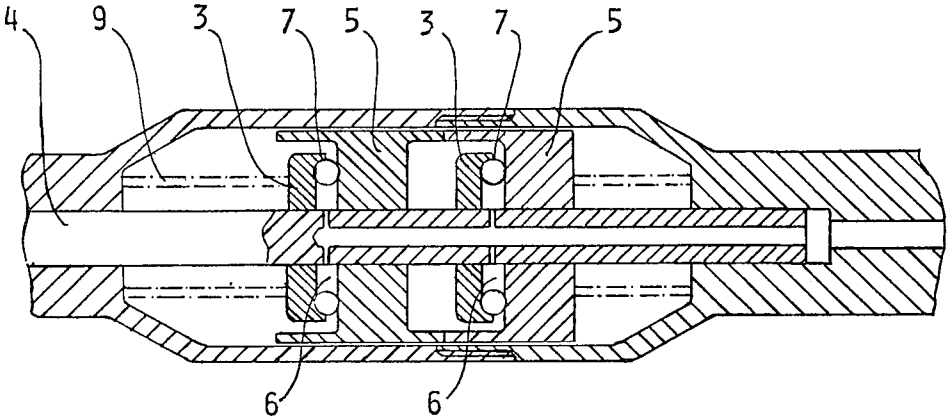
FIG. 2 is a side view of another embodiment of a vibration attenuating device constructed in accordance with the present invention.

A further embodiment of the device constructed in accordance with the invention is illustrated in FIG. 2. The force with which the pressure medium acts on the working member 3 is directly proportional to the size of the surface of the working member—the pressure surface—which forms one wall of the working chamber 6. In case it is desired, for example, for reasons of accessibility, to have a tool with a small diameter, it is possible to increase the pressure surface by having, as shown in FIG. 2, two or more working members 3 sequentially arranged and connected to one another in axial alignment and acting upon the same tool carrier. The stop member 5 is similarly comprised of two or more connected parts in axial alignment. The connected working members 3 are acted upon by a common spring 9 as are the connected stop members 5 acted upon by a common spring 10, with forces being exerted in the same direction as was described for the embodiment shown in FIG. 1. Between each working member and stop member is provided a working chamber 6 with a flexible seal 7. Therefore, this embodiment of the invention also advantageously provides a balanced two mass system with the two masses working in phase away from and towards one another with the same resultant advantages as the embodiment described in FIG. 1.

FIG. 3 shows another embodiment of the present invention by can be arranged between the working and the stop members, because, as was previously explained, the greater the number of seals 7 positioned between the working and stop members, the greater the stroke length.

Devices constructed in accordance with the present invention have been used in hand held chiseling tools operating at frequencies exceeding 200 strokes per second with very good results.

It may be in some instances desirable to make the spring 10 shorter and more rigid than the spring 9. In these instances, the spring 9 should be adjusted to give the working member 3, with its chisel or other tool, the desired stroke length and frequency, while the spring 10 should be yieldable in a limited degree to the pressure that the operator is applying on the tool when using it on a workpiece. In such cases, the stop member 5 should be heavier than the working member 3 with its chisel or other tool, in order that the stop member be capable of balancing the movement of the working member and only moving a lesser distance than the working member.

Even though it may appear at first glance that the action of the pressure medium on the working member 2 is weakened or lessened by the fact that stop member 5 also is affected by and moved because of the pressure exerted in the pressure chamber by the pressure medium, in practice this does not seem to be the result. It appears that, since the velocities of the working member and the stop member are added to each other once said members return to their relaxed position at the end of each stroke, at which time the flexible seal 7 completely seals the pressure chamber again, a very rapid and violent compression of the chamber, i.e., increase of pressure and deformation of the seals, in which energy is stored, occurs, resulting in the members being accelerated again very forcefully in the opposite direction away from one another.

It should be noted that this invention is not limited to the embodiments described above, but can also be applied to fluid pressure operated tools, etc., having other types of impact mechanisms and seals making it possible to arrange working and stop members axially movable relative to each other and to have these members acted upon by springs in a direction towards each other and in a direction away from each other by a pressure medium admitted to at least one working chamber between the members. It is also self-evident that the springs acting on the members can be of any suitable type and are not limited to the helical springs shown in the above described embodiments of the invention. It should also be understood that the above descriptions are given by way of example and not by way of limitation, and that the invention may find a variety of expressions within the scope of the appended claims.

We claim:

1. A balanced two-mass system for attenuating vibrations in implements equipped with a fluid pressure operated impact mechanism, comprising:

a housing for supporting the implement;

a working member and a stop member movably mounted within said housing, said members being in axial alignment and being axially movable relative to one another; resilient means acting upon said working member and said stop member for exerting a force on said working member in a direction towards said stop member and for exerting a force on said stop member in a direction towards said working member;

a pressure chamber defined between said working member and said stop member;

sealing means interconnecting said working member and said stop member such that said pressure chamber is deformable to a predetermined value when said working member and said stop member move apart from each other;

means for supplying a pressure medium to said pressure chamber;

the forces exerted by said pressure medium being effective to drive said working member and said stop member in a direction away from one another beyond said predetermined value such that said sealing means is broken, thereby reducing pressure within said pressure chamber, and resulting in movement of said working member and said stop member toward one another into their initial positions by said forces exerted thereon by said resilient means.

2. A vibration attenuating system as recited in claim 1, wherein said means for supplying said pressure medium to said pressure chamber comprises a conduit, said conduit also functioning as a hollow shaft upon which said stop member is mounted and journalled axially movable.

3. A vibration attenuating system as recited in claim 1, wherein said working member comprises a plurality of plates connected to one another in axial alignment and the stop member comprises a plurality of plates connected to one another in axial alignment, said working member and said stop member defining a plurality of pressure chambers therebetween whereby the surface area of said working member and said stop member upon which said pressure medium acts is increased, thereby increasing the force exerted upon said working member and said stop member by said pressure medium.

4. A vibration attenuating system as recited in claim 1, wherein said means for sealing said pressure chamber includes a flexible O-ring.

5. A vibration attenuating system as recited in claim 1, wherein said means for sealing said pressure chamber comprises a plurality of O-rings arranged in axial alignment with one another said plurality of O-rings interconnecting said working member and said stop member, whereby the maximum distance which said working member and said stop member move apart from each other before said pressure medium escapes from said pressure chamber is adjustable by varying the number of O-rings positioned between said working member and said stop member.

* * * * *